US009399252B2

(12) United States Patent
Fornasier

(10) Patent No.: US 9,399,252 B2
(45) Date of Patent: Jul. 26, 2016

(54) METHOD FOR DETERMINING A STRETCH OF CASTING LINE INCLUDING THE CLOSING POSITION OF THE LIQUID CONE OF A CONTINUOUSLY CAST METAL PRODUCT

(71) Applicant: Danieli & C. Officine Meccaniche S.P.A., Buttrio (IT)

(72) Inventor: Marcellino Fornasier, Spilimbergo (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

(21) Appl. No.: 14/411,471

(22) PCT Filed: Jul. 5, 2013

(86) PCT No.: PCT/EP2013/064291

§ 371 (c)(1),
(2) Date: Dec. 26, 2014

(87) PCT Pub. No.: WO2014/006195

PCT Pub. Date: Jan. 9, 2014

(65) Prior Publication Data

US 2015/0158077 A1 Jun. 11, 2015

(30) Foreign Application Priority Data

Jul. 5, 2012 (IT) ..... MI2012A1185

(51) Int. Cl.

| | |
|---|---|
| ***B22D 2/00*** | (2006.01) |
| ***B22D 11/12*** | (2006.01) |
| ***B22D 11/16*** | (2006.01) |
| ***B22D 11/20*** | (2006.01) |

(52) U.S. Cl.
CPC *B22D 2/00* (2013.01); *B22D 2/003* (2013.01); *B22D 11/1206* (2013.01); *B22D 11/16* (2013.01); *B22D 11/201* (2013.01); *B22D 11/207* (2013.01)

(58) Field of Classification Search
CPC ..... B22D 2/00; B22D 2/003; B22D 11/1206; B22D 11/201; B22D 11/207
USPC ..... 164/451, 478, 416
See application file for complete search history.

(56) References Cited

U.S. PATENT DOCUMENTS 6,129,137 A * 10/2000 Pleschiutschnigg B22D 11/1206 164/476
8,033,318 B2 * 10/2011 Kapaj ..... B22D 11/14 164/442
2006/0005939 A1 * 1/2006 Kunstreich ..... B22D 11/115 164/466

FOREIGN PATENT DOCUMENTS

| | | |
|---|---|---|
| DE | 102004002783 | 8/2005 |
| DE | 102006016375 | 10/2007 |
| DE | 102010014347 | 10/2011 |
| EP | 1369192 | 12/2003 |

* cited by examiner

*Primary Examiner* — Kevin P Kerns
(74) *Attorney, Agent, or Firm* — Stetina Brunda Garred & Brucker

(57) ABSTRACT

A method for determining if a stretch of casting line includes the closing position of the liquid cone of a continuously cast metal product, where there is provided a casting line including an ingot mold containing the liquid metal and in which a meniscus is defined, one or more soft reduction roll devices, cylinders for actuating the one or more soft reduction devices, at least two oscillation application areas, the oscillation application areas being arranged in the one or more soft reduction roll devices. The oscillation being achieved by the rolls of the one or more soft reduction devices through the actuating cylinders. The method includes the following stages: a) applying an oscillation along the casting line to the cast product through at least two application areas in sequence; b) detecting the oscillating frequency of the meniscus level in the ingot mold; c) comparing the oscillating frequency of the meniscus level in the ingot mold with the oscillating frequency of the at least two areas of application.

9 Claims, 5 Drawing Sheets

METHOD FOR DETERMINING A STRETCH OF CASTING LINE INCLUDING THE CLOSING POSITION OF THE LIQUID CONE OF A CONTINUOUSLY CAST METAL PRODUCT

CROSS REFERENCE TO RELATED APPLICATIONS

The present application claims priority to PCT International Application No. PCT/IB2013/064291 filed on Jul. 5, 2013, which application claims priority to Italian Patent Application No. MI2012A001185 filed Jul. 5, 2012, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a method for determining if a particular stretch of casting line includes the closing position of the liquid cone during the continuous casting of metal products, such as slabs, blooms or billets.

STATE OF THE ART

A pressing procedure of cast metal products, e.g. slabs, blooms or billets, in order to achieve a thickness reduction is known from the prior art, in which the cast metal product is subjected to a thickness reduction action while the core is still liquid or partially liquid in a zone downstream of the rolls at the feet of the ingot mold. This pressing action is also named "liquid core reduction" or "soft reduction" of the cast product, and is carried out downstream of the crystallizer, thus obtaining, at the outlet of the continuous casting machine, a smaller thickness of the cast product than that provided by the crystallizer.

The main advantages of the liquid or partially liquid core thickness reduction are such to obtain:

- a cast product of a predetermined size (e.g. thickness) at the outlet of the casting machine using a crystallizer having a larger size than said predetermined size;
- a refinement of the internal solidification structure as well as an improvement of the segregation in the central zone of the cast product.

In order to be effective, soft reduction must occur with continuous, controlled thickness reduction of the cast product until a liquid or partially liquid core remains therein, which condition can be obtained with a substantially conical reduction profile of the concerned cast product segment.

An in-line calculation numerical model, also known as Liquid Pool Control System (LPCS), is used to determine the thermal profile of the cast product and the solidification length of the liquid cone, and assists the soft reduction control to identify the optimal thickness reduction profile and obtain the maximum operational flexibility. Such a numerical model uses operating parameters (liquid steel superheating in tundish, primary cooling and secondary cooling, steel type, casting speed) and can control the cooling profile, and thus the length of the liquid cone, in-line and the opening between the casting line rolls involved in the soft reduction process.

If the cooling profile is not optimal, the same system can also control the secondary cooling, i.e. the cooling carried out downstream of the crystallizer, in order to optimize the solidification process. The whole solidification process can be thus controlled by determining the central equiaxial fraction required to reduce the central segregation: segregation indeed decreases as the thickness of the equiaxial fraction increases.

The numerical model (LPCS) is essentially based on the chemical-physical properties of the product and, by continuously acquiring all process parameters, it calculates the thermal profile and the solidification profile.

With regards to the thermal profile, surface temperature gauges (e.g. pyrometers, thermocouples etc.) can be inserted to validate the model.

In order to evaluate the correctness of the solidified thickness calculation, one method consists in identifying the actual meeting point of the two half skins in the closing position of the liquid cone, i.e. in the final solidification point of the cast product, also called kissing point.

A method for detecting the final solidification point of a slab is described in KR20010045770, which includes analyzing the steel level in the crystallizer and detecting the bulging along the casting line. The method described in this document suggests to place a feeler, which verifies the presence of bulging on the slab, at the various points of the casting line in order to carry out such an analysis in different casting conditions determined by the variation of the following parameters: liquid steel superheating in tundish, primary and secondary cooling, steel type and casting speed. Furthermore, the document includes analyzing the correlation between detected bulging and level fluctuation in the crystallizer to infer whether the liquid cone is still present in the point where the bulging was measured or whether it has been closed further upstream. In order to obtain a specific point where the liquid cone end can be identified, several bulging measurements must be carried out, thus needing to move the measuring instrument to the various points of interest (which operation is not possible during the casting operation) for a given casting condition. Alternatively, it may be possible to vary the casting conditions (e.g. the casting speed) and bring the solidification to an end in the bulging detection point. This approach is not advisable because it requires however a recursive procedure for determining the liquid cone end for the operating condition deemed "optimal" from the operational point of view.

Another method, commercially known as CASTERCROWN, is known for detecting the final solidification point of a slab at the ingot mold outlet. This process consists in equipping the casting line with a specific roll, called CASTERCROWN roll, and with the corresponding support and control structure; by means of said roll an impulse is sent to the slab to evaluate the response thereof in terms of structure strength and resonance. According to the obtained elastic reaction, it is possible to infer whether a liquid core is present in the oscillation application point or whether instead the slab is completely solidified. The line must be equipped with additional devices even for this method. In particular, the CASTERCROWN roll must be placed instead of a roll (e.g. a pinch roll) normally fitted on the casting line. As in the method described in KR20010045770, the CASTERCROWN method also requires moving the CASTERCROWN roll to carry out the check at different points of the casting line. Alternatively, a plurality of CASTERCROWN rolls may be used with a proportional excessive cost. Furthermore, in the latter case, there are limitations related to providing an adequate slab containment along the casting line.

SUMMARY OF THE INVENTION

It is the main object of the present invention to provide a method for accurately identifying a short stretch of casting line including the final solidification point of a continuously cast metal product, such as a slab, bloom or billet, so as to define accordingly the optimal profile of thickness reduction by means of soft reduction rolls, using only the equipment normally installed on a continuous casting machine which applies the soft reduction process.

The present invention thus suggests to reach the above-discussed objects by means of a method for determining if a stretch of casting line includes the closing position of the liquid cone of a continuously cast metal product, wherein there is provided a casting line comprising:

an ingot mold containing the liquid metal and in which a meniscus is defined, one or more soft reduction roll devices, cylinders for actuating said one or more soft reduction devices, at least two areas of application of a periodic oscillating impulse along the casting line, said at least two areas defining end areas of said stretch of casting line, the method comprising the following stages:

a) sequentially applying a first periodic oscillating impulse to a first area of application represented by a first actuating cylinder, thus causing a first oscillation on the cast product, and then a second periodic oscillating impulse to a second area of application represented by a second actuating cylinder, thus causing a second oscillation on the cast product;

b) detecting the oscillating frequency of the meniscus level in the ingot mold both during the application of said first periodic oscillating impulse and during the application of said second periodic oscillating impulse;

c) comparing the oscillating frequency of the meniscus level in the ingot mold with the oscillating frequency of the first area of application during the application of said first periodic oscillating impulse, and comparing the oscillating frequency of the meniscus level in the ingot mold with the oscillating frequency of the second area of oscillation during the application of said second periodic oscillating impulse, wherein stage c) is carried out by comparing a frequency spectrum of a signal of the meniscus level in the ingot mold with frequency spectra of force or position of said first actuating cylinder and said second actuating cylinder, respectively; whereby if the compared spectra are superimposable, a liquid core is present in the cast product at the area where the periodic oscillating impulse is applied, otherwise the cast product is completely solidified in said area, whereby if, by comparing the oscillating frequency of the meniscus level in the ingot mold with the oscillating frequency of the first area of application, the compared spectra are superimposable, and if, by comparing the oscillating frequency of the meniscus level in the ingot mold with the oscillating frequency of the second area of application, the compared spectra are not superimposable, a liquid core is present in the cast product at the first area while the cast product is completely solidified at the second area, the closing position of the liquid cone being thus included in said stretch of casting line.

The first periodic oscillating impulse and the second periodic oscillating impulse are preferably equal.

The method, object to the present invention, is based on the frequency analysis of the meniscus level in the ingot mold following a periodic oscillating impulse, e.g. of the sinusoidal type, applied to the cast product (slab or bloom or billet) by the rolls along the casting line, which may vary their position or force with respect to the cast product by means of hydraulic cylinders.

In the case of slabs, said sinusoidal impulse may be applied by the actuating cylinders of the soft reduction roll segments, also known as clamping cylinders. Alternatively, the impulse may also be applied by the motorized rolls (pinch rolls) within the soft reduction segments and provided with autonomous actuating cylinders.

In the case of blooms or billets, said sinusoidal impulse may be applied by the actuating cylinders of the extractor rolls (pinch rolls).

In order to confirm that the closing point of the liquid cone of the cast product is localized where estimated or where calculated by the online numerical model, when present, or to determine the stretch of casting line including said closing point from the beginning, the method includes applying, by means of hydraulic cylinders of the rolls along the casting line, oscillations or impulses to the cast product at two or more areas and comparing the oscillating frequency (referred to position or force) applied by said hydraulic cylinders with the oscillating frequency measured at the meniscus level in the ingot mold. If the two frequencies (position or force of the hydraulic cylinders and level in the ingot mold) correspond, i.e. if the spectra are superimposable, the liquid is still present within the cast product. If the oscillating frequency of the hydraulic cylinders is not detected in the frequency spectrum of the meniscus level in the ingot mold (analysis of the fast Fourier transform or FFT), the cast product is completely solidified.

Two frequency spectra are superimposable when the oscillating frequency of the meniscus level in the ingot mold has a trend corresponding to the trend of the oscillating frequency detected by the force or position of an area of application. In particular two frequency spectra are deemed to be superimposable when the main peak of the frequency of the meniscus level in the ingot mold matches with the eigenfrequency of the soft reduction segment or pinch roll oscillation within a tolerance of +/−0.04 Hz, preferably of +/−0.02 Hz. The working range of the segment or pinch roll oscillation frequency is in the range 0.01 Hz-1 Hz with an amplitude range from 0.1 mm to 10 mm maximum.

Advantageously, with the method of the invention, the meniscus level in the ingot mold is not subject to significant variations which may negatively affect the casting process, as the force or amplitude of the oscillations imposed by the activated hydraulic cylinders is low, and especially because the oscillating frequencies used are such that the control system of the level in the ingot mold can maintain the actual level within the optimal range practically in all operational casting conditions.

Therefore, the method of the present invention does not produce any relevant interference with the casting process, while the final quality of the cast product is improved, instead.

The method of the invention may be used to find a narrow stretch of casting line containing the closing point of the liquid cone either starting from the prediction provided by an online numerical model or without an initial reference.

In the first case, once the theoretical closing point of the liquid cone has been calculated with the numerical model, the method of the invention provides for oscillating first one area of application upstream of said theoretical closing point and then one area of application downstream of said theoretical point, so as to check whether the real closing point of the liquid cone is included between said two oscillation application areas. The oscillating frequency of the meniscus level in the ingot mold and the oscillating frequency of the position or force of the first area of application will correspond if the prediction is correct, while the oscillating frequency of the meniscus level in the ingot mold and that of the second area of application will not correspond.

In the second case, or if an analysis carried out on two areas of application indicates that the result of the numerical model was incorrect, the whole casting line or a limited zone thereof can be analyzed. In this case, all the subsequent application areas of interest will be oscillated, one after the other, until the area of application is identified where there is no correspondence with the oscillating frequency detected at the meniscus level in the ingot mold.

Once the narrow stretch of casting line including the closing point of the liquid cone in the cast product has been accurately established, either the soft reduction roll segments (for slab casting) or the pinch rolls (for bloom or billet casting) can all be organized and positioned upstream and downstream of said stretch of casting line, so as to end the soft reduction substantially at the actual position in which the liquid cone closes, thus setting all the thicknesses between the casting line components to reach the kissing point with the required slab/bloom/billet thickness at the casting machine outlet and ensuring an excellent quality within the cast product.

The method, object of the intervention, has the following advantages:

- no additional equipment is required because only the equipments already present on a continuous casting machine, provided with soft reduction devices and automatic control devices of the meniscus level in the ingot mold;
- an additional software, which may be managed by the automation (PLC) already present, is sufficient;
- no interference on the casting process and the final quality of the product is not jeopardized;
- it allows to accurately find a narrow stretch of casting line including the kissing point even as the casting parameters vary;
- the actual position of said stretch of casting line is identified very quickly.

The dependent claims describe preferred embodiments of the invention.

BRIEF DESCRIPTION OF THE DRAWINGS

Further features and advantages of the present invention will become more apparent in the light of the detailed description of preferred, but not exclusive embodiments of a method for determining a stretch of casting line including the closing position of the liquid cone of a continuously cast metal product, shown by the way of non-limitative example, with reference to the accompanying drawings, in which.

The same reference numbers in the figures identify the same elements or components.

DETAILED DESCRIPTION OF PREFERRED EMBODIMENTS OF THE INVENTION

The method for determining if a stretch of casting line includes the closing position of the liquid cone of a continuously cast metal product, object of the present invention, includes using conventional equipment only, normally installed in a continuous casting machine which applies the soft reduction process.

Figure 1B:
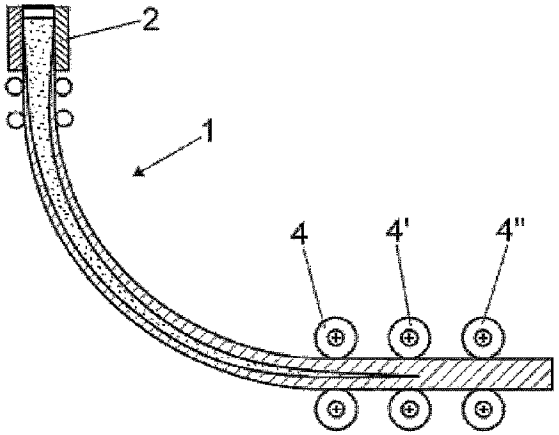
Fig. 1b PRIOR ART
FIG. 1*b* is a section view of a continuous casting machine for casting blooms or billets provided with pinch rolls.
Figure 1C:
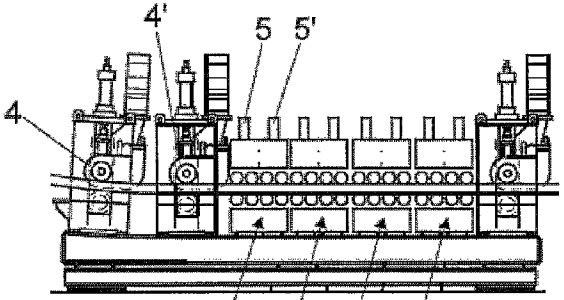
Fig. 1c PRIOR ART
FIG. 1*c* is a section view of a portion of a continuous casting machine for casting blooms or billets provided with pinch rolls and with soft reduction roll segments.
Figure 1A:
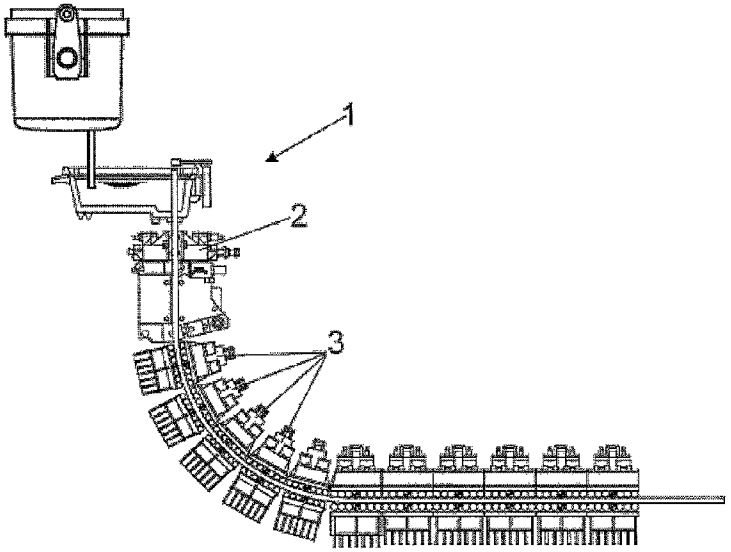
Fig. 1a PRIOR ART
FIG. 1*a* is a section view of a continuous casting machine for casting slabs provided with soft reduction roll segments.

FIG. 1*a* shows a continuous casting machine 1 for casting slabs which includes a plurality of soft reduction roll segments 3 downstream of the ingot mold 2.

Figure 2B:
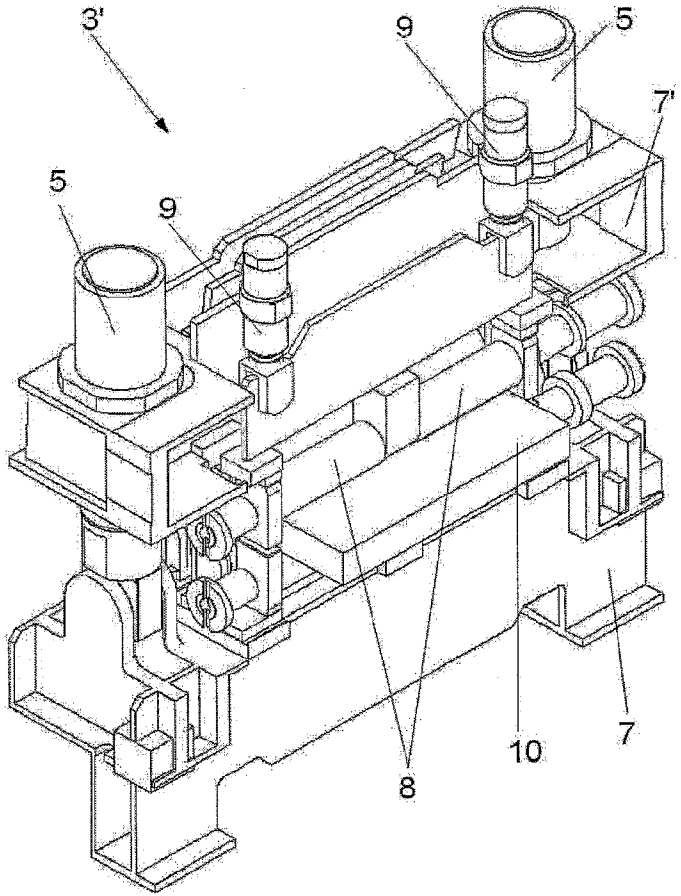
FIG. 2*b* is a section view of a further soft reduction roll segment.
Figure 2A:
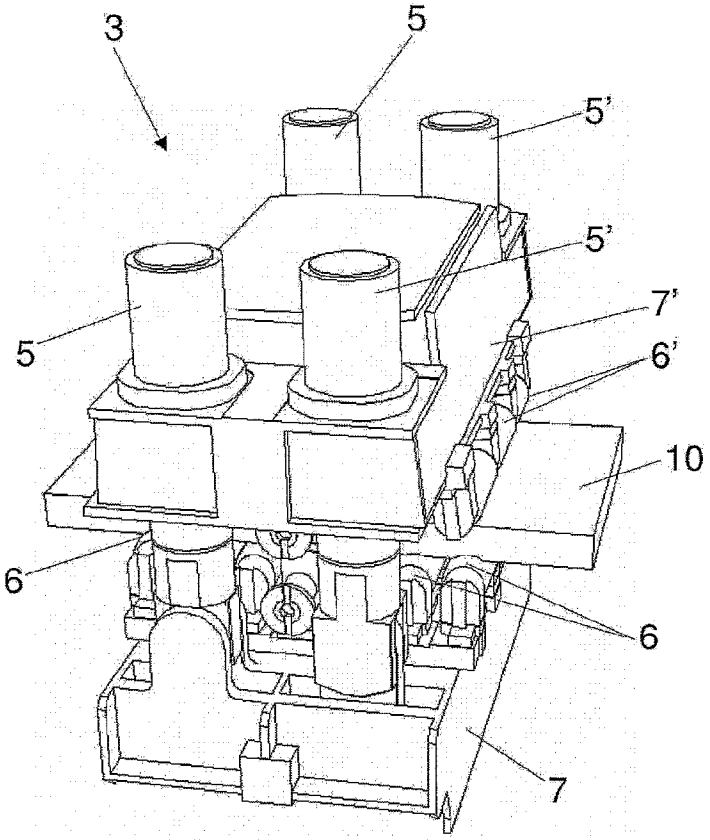
FIG. 2*a* is a perspective view of a soft reduction roll segment in FIG. 1*a;*

FIG. 2*a* shows one of said soft reduction segments 3, comprising four actuating (clamping) cylinders 5, 5' of the segment, a number "n" of rolls 6 on the fixed side 7 and "n" rolls 6' on the movable containing side 7' of the slab 10.

The two actuating cylinders 5 at the inlet of the segment 3 form a first pair of actuating cylinders, while the two actuating cylinders 5' at the outlet of the segment 3 form a second pair of actuating cylinders.

A first variant of the method of the invention includes using the first pair and the second pair of actuating cylinders 5, 5' of the soft reduction segments 3 as subsequent areas of application, on the cast product, of an oscillation or periodic impulse, e.g. of the sinusoidal type. This first variant includes the following stages:

- sequentially applying a first periodic oscillating impulse on the first pair of actuating cylinders 5, thus causing a first oscillation on the cast product, and then a second periodic oscillating impulse on the second pair of actuating cylinders 5', thus causing a second oscillation on the cast product;
- detecting the oscillating frequency of the meniscus level in the ingot mold both during the application of said first periodic oscillating impulse and during the application of said second periodic oscillating impulse;
- comparing the oscillating frequency of the meniscus level in the ingot mold with the oscillating frequency of the first pair of actuating cylinders 5 during the application of said first periodic oscillating impulse, and comparing the oscillating frequency of the meniscus level in the ingot mold with the oscillating frequency of the second pair of actuating cylinders 5' during the application of said second periodic oscillating impulse.

FIG. 2*b* shows one of said soft reduction segments 3 comprising four actuating cylinders of the segment, a number "n" of rolls on the fixed side 7 and "n" rolls 6' on the movable containing side 7' of slab 10.

The two actuating cylinders 5 at the inlet of the segment 3 form a first pair of actuating cylinders, while the two actuating cylinders 5' (not shown in FIG. 2*b*) at the outlet of the segment 3 form a second pair of actuating cylinders.

Within the segment in FIG. 2*b*, unlike the segment in FIG. 2*a*, there is a motorized roll or pinch roll 8, actuated by two independent hydraulic actuating cylinders 9, in place of one of the standard rolls of the segment, preferably in place of a central standard roll. The function of this motorized roll 8 is to ensure the contact with slab 10 and to perform a feeding action of the slab itself along the casting line. Such a motorized roll 8 is normally force-controlled.

A second variant of the method of the invention includes using the first pair of actuating cylinders 5 of the segment 3 and the pair of independent hydraulic actuating cylinders 9 of the pinch roll 8 as subsequent areas of application of an oscillation or periodic impulse. This second variant includes the following stages:

sequentially applying a first periodic oscillating impulse on the first pair of actuating cylinders 5, thus causing a first oscillation on the cast product, and then a second periodic oscillating impulse on the pair of actuating cylinders 9 of the pinch roll 8, thus causing a second oscillation on the cast product;

detecting the oscillating frequency of the meniscus level in the ingot mold both during the application of said first periodic oscillating impulse and during the application of said second periodic oscillating impulse;

comparing the oscillating frequency of the meniscus level in the ingot mold with the oscillating frequency of the first pair of actuating cylinders 5 during the application of said first periodic oscillating impulse, and comparing the oscillating frequency of the meniscus level in the ingot mold with the oscillating frequency of the pair of actuating cylinders 9 of the pinch roll 8 during the application of said second periodic oscillating impulse.

A third variant of the method of the invention includes using the pair of actuating cylinders 9 of the pinch roll 8 and the second pair of actuating cylinders 5' at the outlet of the segment 3 as subsequent areas of application of an oscillation or periodic impulse. This third variant includes the following stages:

sequentially applying a first periodic oscillating impulse on the pair of actuating cylinders 9 of the pinch roll 8, thus causing a first oscillation on the cast product, and then a second periodic oscillating impulse on the second pair of actuating cylinders 5', thus causing a second oscillation on the cast product;

detecting the oscillating frequency of the meniscus level in the ingot mold both during the application of said first periodic oscillating impulse and during the application of said second periodic oscillating impulse;

comparing the oscillating frequency of the meniscus level in the ingot mold with the oscillating frequency of the pair of actuating cylinders 9 of the pinch roll 8 during the application of said first periodic oscillating impulse, and comparing the oscillating frequency of the meniscus level in the ingot mold with the oscillating frequency of the second pair of actuating cylinders 5' during the application of said second periodic oscillating impulse.

A fourth variant of the method of the invention includes using the second pair of actuating cylinders 5' at the outlet of a first soft reduction segment and the first pair of actuating cylinders 5 at the inlet of a second soft reduction segment, following the first segment, as subsequent areas of application of an oscillation or periodic impulse. This fourth variant includes the following stages:

sequentially applying a first periodic oscillating impulse on the second pair of actuating cylinders 5' at the outlet of the first soft reduction segment, thus causing a first oscillation on the cast product, and then a second periodic oscillating impulse on the first pair of actuating cylinders 5 at the inlet of the second soft reduction segment, thus causing a second oscillation on the cast product;

detecting the oscillating frequency of the meniscus level in the ingot mold both during the application of said first periodic oscillating impulse and during the application of said second periodic oscillating impulse;

comparing the oscillating frequency of the meniscus level in the ingot mold with the oscillating frequency of the second pair of actuating cylinders 5' of the first soft reduction segment during the application of said first periodic oscillating impulse, and comparing the oscillating frequency of the meniscus level in the ingot mold with the oscillating frequency of the first pair of actuating cylinders 5 at the inlet of the second soft reduction segment during the application of said second periodic oscillating impulse.

A fifth variant of the method of the invention includes using instead the following three oscillation application areas in sequence: the first pair of actuating cylinders 5 of a soft reduction segment 3, the second pair of actuating cylinders 5' of said soft reduction segment 3 and, if the kissing point is between said two pairs of actuating cylinders, even the pair of independent, hydraulic actuating cylinders 9 of the pinch roll 8, in order to determine a narrower stretch including the closing point of the liquid cone with yet greater accuracy. This fifth variant includes the same stages as the first variant with the addition of the following stages if the comparison of the oscillating frequency of the meniscus level in the ingot mold with the oscillating frequencies of the first pair and of the second pair of actuating cylinders 5, 5' has shown that the liquid cone closes between said two pairs of cylinders:

applying a third periodic oscillating impulse on the pair of actuating cylinders 9 of the pinch roll 8, thus causing a third oscillation on the cast product;

detecting the oscillating frequency of the meniscus level in the ingot mold during the application of said third periodic oscillating impulse;

comparing the oscillating frequency of the meniscus in the ingot mold with the oscillating frequency of the pair of actuating cylinders 9 of the pinch roll 8 during the application of said third periodic oscillating impulse.

FIG. 1*b* shows a continuous casting machine 1 for casting blooms or billets in which at least two pinch rolls 4, 4', 4" are provided in the end part of the casting machine, which in addition to acting as extractors or straightening rolls, may also carry out the soft reduction operation. Said pinch rolls 4, 4', 4", spaced apart by 1.5 meters, for example, are each controlled by an independent hydraulic cylinder.

A sixth variant of the method of the invention includes using the actuating cylinder of a first pinch roll 4 and the actuating cylinder of a second pinch roll 4' as subsequent areas of application of an oscillation or periodic impulse. This sixth variant includes the following stages:

sequentially applying a first periodic oscillating impulse on the actuating cylinder of the first pinch roll 4, thus causing a first oscillation on the cast product, and then a second periodic oscillating impulse on the actuating cylinder of the second pinch roll 4', thus causing a second oscillation on the cast product;

detecting the oscillating frequency of the meniscus level in the ingot mold both during the application of said first periodic oscillating impulse and during the application of said second periodic oscillating impulse;

comparing the oscillating frequency of the meniscus level in the ingot mold with the oscillating frequency of the actuating cylinder of the first pinch roll 4 during the application of said first periodic oscillating impulse, and comparing the oscillating frequency of the meniscus level in the ingot mold with the oscillating frequency of the actuating cylinder of the second pinch roll 4' during the application of said second periodic oscillating impulse.

FIG. 1*c* shows a portion of a continuous casting machine for casting blooms or billets in which a plurality of soft reduction segments 3' are also provided in the end part of the casting machine in addition to at least two pinch rolls 4, 4'. The soft reduction segments 3' are similar to those used for slab casting with the sole difference that a single actuating cylinder 5, 5' is provided both at the inlet and at the outlet of each segment 3' instead of a pair of actuating cylinders.

In this case the method of the invention, in addition to all the above-described variants, may be performed using, as subsequent areas of application of a periodic oscillation or a periodic oscillating impulse:

an actuating cylinder of one of the pinch rolls 4, 4' and an actuating cylinder 5 at the inlet of one of the soft reduction segments 3'; or an actuating cylinder of one of the pinch rolls 4, 4' and an actuating cylinder 5' at the outlet of one of the soft reduction segments 3'; or an actuating cylinder of one of the pinch rolls 4, 4' and an actuating cylinder of a further pinch roll provided within one of the soft reduction segments 3'.

In all the above-described variants of the method of the invention, since the conventional machines are provided with a series of pinch rolls and/or a series of soft reduction roll segments, there are many possible areas of application of the oscillation or impulse along the casting line at substantially regular intervals, which may also cover the whole length of the continuous casting machine. Furthermore, since the distance between two subsequent impulse application areas along the casting line may be very close, the method of the invention allows to analyze a localized zone of the cast product (slab or bloom or billet) in which the presence of the kissing point is to be identified. Thereby, the search can be refined to a narrow area and the kissing point can be identified with great accuracy.

In all the above-described variants of the method of the invention, the oscillating impulse imposed at each area of application is typically a sinusoidal impulse with a pulsing period of about 1 to 2 minutes and, advantageously, with frequencies from 10.sup.−3 to 10 Hz. Excellent results have been obtained by using frequencies from 10.sup.−2 to 5 Hz.

If the hydraulic cylinders which apply the impulse are position-controlled, such as the actuating cylinders typically used in the soft reduction segments, the amplitude of the oscillation of the imposed position is less than 5 mm, preferably less than 2 mm.

If the hydraulic cylinders which apply the impulse are force-controlled, such as the actuating cylinders typically used for pinch rolls, the amplitude of the oscillation of the imposed force is less than 80% of the nominal value of the force exerted by said actuating cylinders.

Figure 3:
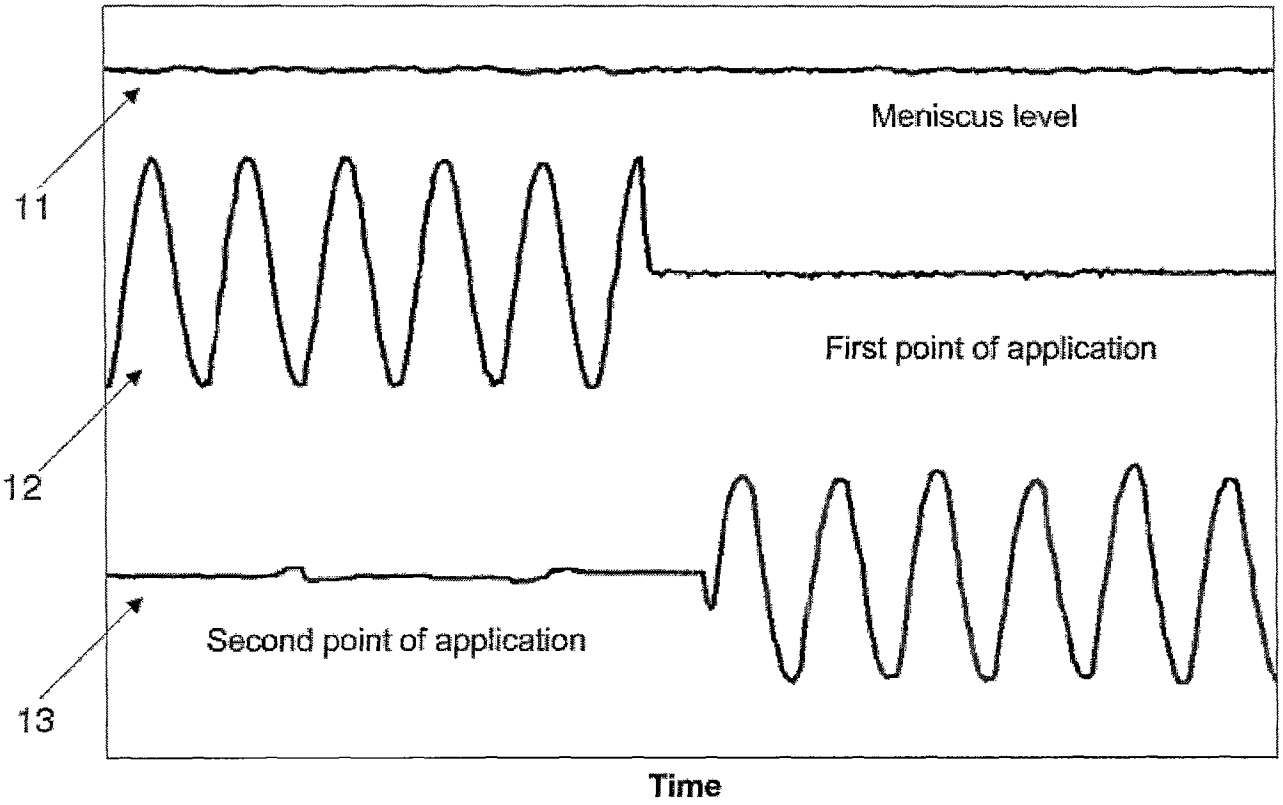
FIG. 3 is an exemplary chart showing the meniscus level in the ingot mold, the position of the actuating cylinders of a roll segment upstream of the kissing point, and the position of the actuating cylinders of a roll segment downstream of the kissing point.

FIG. 3 shows a sequence of oscillations imposed at subsequent areas of application: each element is individually oscillated in sequence. In particular, reference numeral 11 indicates the trend of the meniscus level in the ingot mold over time; reference numeral 12 indicates the trend of the position of a first area of application upstream of the presumed kissing point; reference numeral 13 indicates the trend of the position of a second area of application downstream of the presumed kissing point.

All variants of the method of the invention include frequency spectrum analysis of the detected signal of the meniscus level in the ingot mold, e.g. detected by means of a sensor which may be radioactive, optical, magnetic or thermal, and the analysis of the frequency spectrum of the force or position of the hydraulic cylinders detected by the force transducer in the actuating cylinders of the pinch rolls or by the position transducers in the actuating cylinders of the soft reduction segments, respectively.

By applying fast Fourier transform (FFT), for example, or possibly other known methods for the frequency spectrum analysis, the oscillating frequency of the force or position of the cylinders used as areas of application of the oscillating impulse is directly compared with the oscillating frequency of the meniscus level in the ingot mold.

Figure 4A:
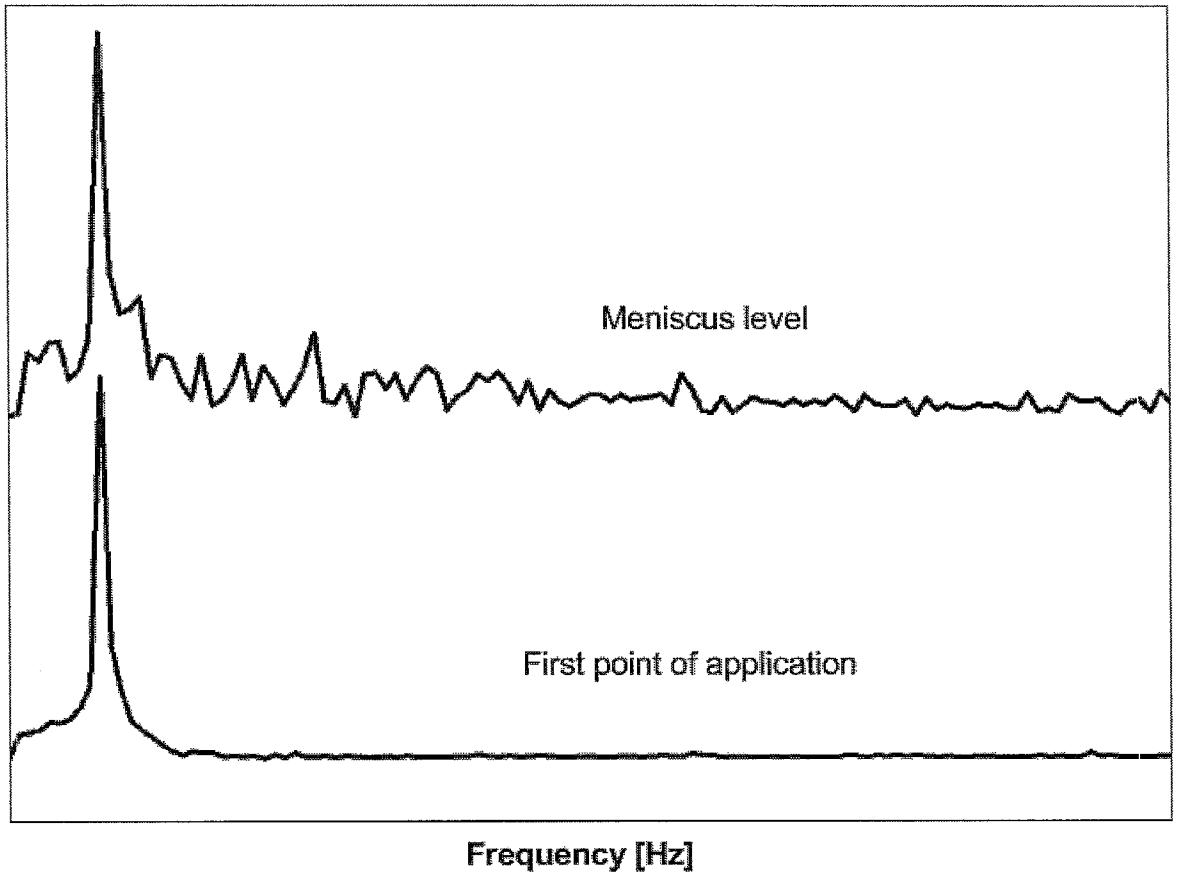
FIG. 4*a* is a chart showing the oscillating frequency of the meniscus level in the ingot mold and the oscillating frequency detected by the force or position of an area of application in an example in which a liquid portion in the cast product is present in said area of application.
Figure 4B:
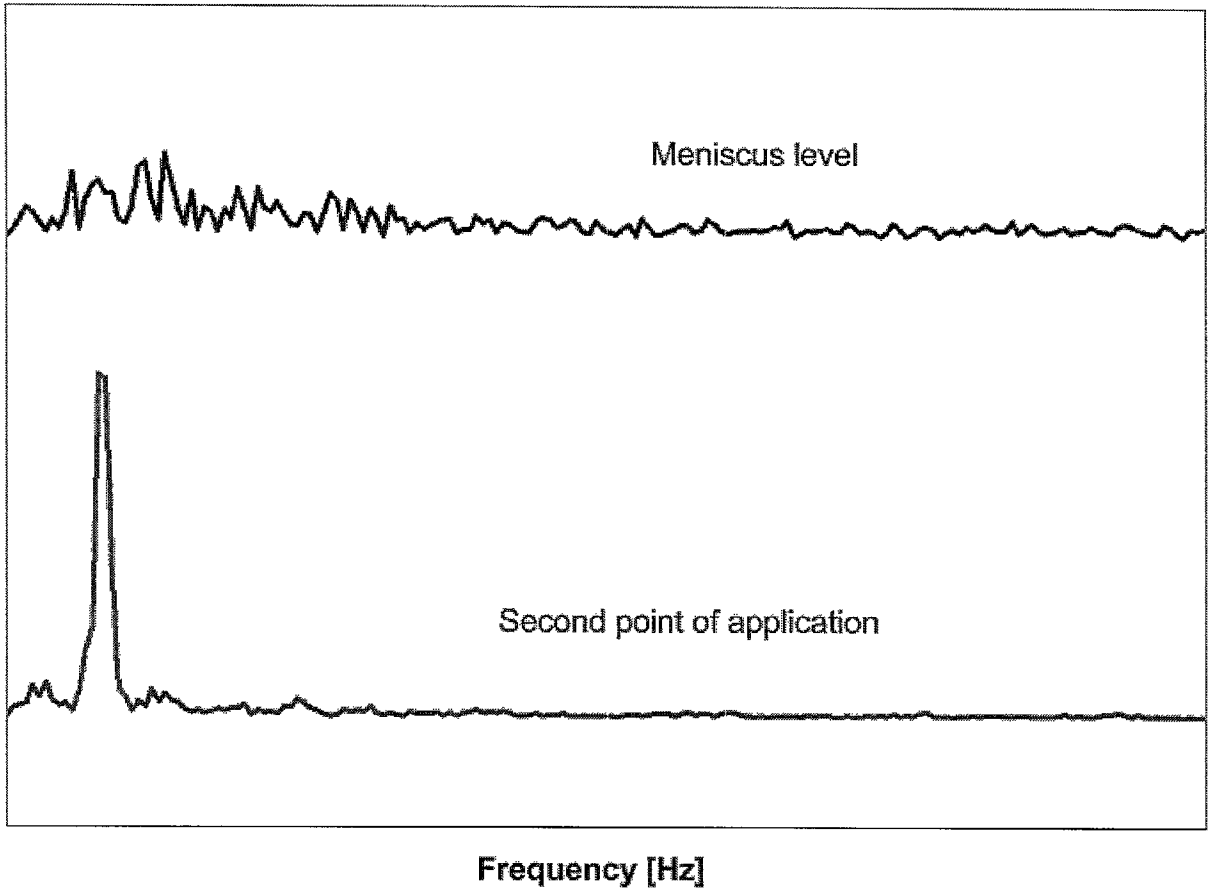
FIG. 4*b* is a chart showing the oscillating frequency of the meniscus level in the ingot mold and the oscillating frequency detected by the force or position of an area of application in an example in which the cast product is completely solidified in said area of application.

If the two frequencies (force or position of the area of application and level in the ingot mold) correspond, i.e. the two spectra are superimposable (FIG. 4*a*), a liquid core is still present in the area where the oscillating impulse was applied; if instead the two frequencies do not correspond, i.e. if the two spectra are not superimposable (FIG. 4*b*), the cast product (slab or bloom or billet) is completely solidified and a liquid core is no longer present in the area where the oscillating impulse was applied.

The two frequency spectra are superimposable when (see, for example, FIG. 4*a*) the oscillating frequency of the meniscus level in the ingot mold has a trend corresponding to the trend of the oscillating frequency of the force or position of an area of application. In particular two frequency spectra are deemed to be superimposable when the main peak of the frequency of the meniscus level in the ingot mold matches, within a tolerance of +/−0.04 Hz, preferably of +/−0.02 Hz, with the corresponding eigenfrequency of the force or position of an area of application, detected by force transducer in the actuating cylinders of the pinch rolls or by position transducers in the actuating cylinders of the soft reduction segments, respectively. The working range of the oscillating frequency of the soft reduction segment or the pinch roll is in the range 0.01 Hz-1 Hz with an amplitude range from 0.1 mm to 10 mm maximum.

The invention claimed is:

1. A method for determining if a stretch of casting line includes a closing position of a liquid cone of a continuously cast metal product, wherein there is provided a casting line comprising an ingot mold containing a liquid metal and in which a meniscus is defined, one or more soft reduction devices with rolls, actuating cylinders for actuating said one or more soft reduction devices, at least two areas of application of a periodic oscillating impulse along the casting line, said at least two areas defining end areas of said stretch of casting line, the method comprising the following stages:

a) sequentially applying a first periodic oscillating impulse to a first area of application represented by a first actuating cylinder, thus causing a first oscillation on the cast product, and then a second periodic oscillating impulse to a second area of application represented by a second actuating cylinder, thus causing a second oscillation on the cast product;

b) detecting an oscillating frequency of a meniscus level in the ingot mold both during the application of said first periodic oscillating impulse and during the application of said second periodic oscillating impulse;

c) comparing the oscillating frequency of the meniscus level in the ingot mold with the oscillating frequency of the first area of application during the application of said first periodic oscillating impulse, and comparing the oscillating frequency of the meniscus level in the ingot mold with the oscillating frequency of the second area of application during the application of said second periodic oscillating impulse, wherein stage c) is carried out by comparing a frequency spectrum of a signal of the meniscus level in the ingot mold with frequency spectra of force or position of said first actuating cylinder and said second actuating cylinder, respectively; whereby if the compared spectra are superimposable, a liquid core is present in the cast product in either of the first or second areas where the first or second periodic oscillating impulse is applied, respectively, otherwise the cast product is completely solidified, whereby if, by comparing the oscillating frequency of the meniscus level in the ingot mold with the oscillating frequency of the first area of application, the compared frequency spectra are superimposable, and if, by comparing the oscillating frequency of the meniscus level in the ingot mold with the oscillating frequency of the second area of application, the compared spectra are not superimposable, a liquid core is present in the cast product at the first area while the cast product is completely solidified at the second area, the closing position of the liquid cone being thus included in said stretch of casting line.

2. A method according to claim 1, wherein the first periodic oscillating impulse and the second periodic oscillating impulse; are of the sinusoidal type.

3. A method according to claim 2, wherein said first periodic oscillating impulse and said second periodic oscillating impulse have a duration of application of 1 to 2 minutes and a frequency from $10^{-3}$ to 10 Hz.

4. A method according to claim 3, wherein the frequency of said first periodic oscillating impulse and said second, periodic oscillating impulse is from $10^{-2}$ to 5 Hz.

5. A method according to claim 1, wherein the analysis of the frequency spectrum is carried out by applying a Fast Fourier Transform (FFT).

6. A method according to claim 1, wherein the casting line comprises at least one first pinch roll and one second, pinch roll, and said at least two areas of application of the periodic oscillating impulse are represented by an actuating cylinder of the first pinch roll and by an actuating cylinder of the second pinch roll arranged downstream of the first pinch roll, said first pinch roll and second pinch roll acting as soft reduction devices.

7. A method according to claim 1, wherein the casting line comprises at least one segment of soft reduction rolls and said at least two areas of application of the periodic oscillating impulse are represented by a pair of actuating cylinders provided at the inlet of a segment of soft reduction rolls and a pair of actuating cylinders provided at the outlet of said segment of soft reduction rolls or a pair of actuating cylinders of a motorized roll arranged within said segment of soft reduction rolls; or said at least two areas of application of the periodic oscillating impulse are represented by a pair of actuating cylinders of a motorized roll arranged within said segment of soft reduction rolls and by a pair of actuating cylinders provided at the outlet of said segment of soft reduction rolls.

8. A method according to claim 1, wherein the casting, line comprises at least one pinch roll and at least one segment of soft reduction rolls, and said at least two areas of application of the periodic oscillating impulse are represented by an actuating cylinder of a pinch roll and by an actuating cylinder provided at the inlet of a soft reduction segment arranged downstream of said pinch roll, or they are represented by an actuating cylinder of a pinch roll and by an actuating cylinder provided at the outlet of a soft reduction segment arranged downstream of said pinch roll, or they are represented by an actuating cylinder of a pinch roll, downstream of the ingot mold, and by an actuating cylinder of a motorized roll provided within a soft reduction segment, downstream of said pinch roll.

9. A method according to claim 1, wherein in the case of position-controlled hydraulic actuating cylinders, a position oscillation has an amplitude of less than 5 mm; and wherein in the case of force-controlled hydraulic actuating cylinders, a force oscillation has an amplitude of less than 80% of the nominal value of a force exerted by said hydraulic actuating, cylinders.

* * * * *